United States Patent [19]

Murai et al.

[11] Patent Number: 4,539,279

[45] Date of Patent: Sep. 3, 1985

[54] IMAGE DENSITY CONTROL METHOD

[75] Inventors: Kazuo Murai; Yutaka Hasegawa, both of Tokyo, Japan

[73] Assignee: Ricoh Company, Ltd., Tokyo, Japan

[21] Appl. No.: 549,385

[22] Filed: Nov. 7, 1983

[30] Foreign Application Priority Data

Nov. 11, 1982 [JP] Japan ..... 57-197939

[51] Int. Cl.[3] ..... G03G 21/00

[52] U.S. Cl. ..... 430/30; 118/688; 118/651; 355/14 D

[58] Field of Search ..... 430/30; 118/688, 651

[56] References Cited

U.S. PATENT DOCUMENTS 4,313,671 2/1983 Kuru ..... 118/688 X 4,372,672 2/1983 Pries ..... 118/688 X

*Primary Examiner*—John D. Welsh

*Attorney, Agent, or Firm*—David G. Alexander

[57] ABSTRACT

An image density control method for an electrophotographic apparatus is disclosed which prepares a white pattern region and a black pattern region on a photoconductive element whose electrostatic latent images are far different from each other in potential. Values relating to image densities individually associated with the two pattern regions are sensed and, based on the sensed values, parameters relating to image processing which effect image density are controlled. When any of the sensed values does not lie in a predetermined range, it is suitably compensated.

14 Claims, 15 Drawing Figures

| Fig. 2 A | Fig. 2 B |
|---|---|

| | |
|---|---|
| Fig. 5A-1 | Fig. 5A-3 |
| Fig. 5A-2 | Fig. 5A-4 |

※※

| FIRST TONER COUNTER | | | | | | | | SECOND TONER COUNTER | | | | | | | |
|---|---|---|---|---|---|---|---|---|---|---|---|---|---|---|---|
| $b_{15}$ | – | – | – | – | – | $b_9$ | $b_8$ | $b_7$ | – | – | – | $b_3$ | $b_2$ | $b_1$ | $b_0$ |
| X | X | X | X | X | X | X | X | 0 | 0 | 0 | 0 | 0 | 0 | 0 | 0 |

| | |
|---|---|
| Fig. 5B-1 | Fig. 5B-3 |
| Fig. 5B-2 | Fig. 5B-4 |

IMAGE DENSITY CONTROL METHOD

BACKGROUND OF THE INVENTION

The present invention relates to an image density control method for an electrophotographic apparatus and, more particularly, to an image density control method which forms at least two test patterns on the surface of a photoconductive element which differ a great deal in latent image potential from each other, senses values relating to image densities of the patterns or of copy images associated with the patterns, and, based on the sensed values, controls some parameters relating to image processing which have influence on image density.

In an apparatus for electrophotography or electrostatic recording, a latent image electrostatically formed on a photoconductive element by a given method is generally developed by a developer which is supplied from a developing unit and contains microscopic colored particles called "toner'. Usually, a toner is charged to a polarity opposite to that of the latent image and electrostatically deposited on the latent image to turn it into a toner image. Because the toner itself is consumed by the development, it is necessary to maintain the toner concentration in the developer constant or to make the toner supply to the developing unit constant in quantity. This demand may be implemented by measuring a toner concentration in the developer, a density of the image developed by the toner, or their associated values, and, when the density is short, supplying the toner to the developing unit or controlling various parameters which effect the density.

The control of the type described above is disclosed in, for example, Japanese Patent Publication Nos. 43-16199/1968 and 47-18600/1972, Japanese Patent Laid Open Publication Nos. 53-12336/1978, 53-90940/1978, 53-92138/1978, 53-95042/1978, 53-95043/1978, 53-95044/1978, 53-106129/1978, 54-97038/1979 and 54-97044/1979, and U.S. Pat. No. 2,956,487.

In regard to such a control, Japanese Patent Application 56-80309 teaches a toner density control method which senses densities of developed images representative of white and black test patterns respectively, and supplying a toner to a developing unit in such a manner as to maintain the ratio between the sensed values constant. Further, Japanese Patent Application No. 56-184289/1981 discloses an image density control method including a pattern read control which facilitates the control over the timings for detecting white and black patterns.

In the above-stated Japanese Patent Application No. 56-184289/1981, for example, after an area of a photoconductive element exposed to a white pattern is developed, a light emitting diode (LED) of a density sensor is so controlled as to emit a quantity of light which gives a predetermined signal level indicative of a density of the white pattern, e.g. 4.0 V. Meanwhile, after an area of the photoconductor exposed to a black pattern is developed, the toner is supplied to a developing unit only when a signal level indicative of a density of the black pattern increases beyond a reference voltage, e.g. 1.6 V. Naturally, such reference voltages are not restrictive and may be replaced by others. In detail, if settings for energizing a density sensor is inadequate or settings or adjustment of an analog circuit for processing output signals of the sensor is inadequate, the sensor output level tends to shift to a higher side or to a lower side. For example, where the LED of the sensor is conditioned to emit a quantity of light somewhat higher than a reference value, an excessive amount of toner will be supplied resulting in scattering of the toner or like occurrence. Conversely, where the quantity of light emanating from the LED is somewhat smaller than the reference value, a carrier will be scattered due to short toner supply. Such occurrences are observed not only when the circuit setting or adjustment is improper but also when the patterns themselves are incomplete or the sensor is contaminated, for example.

Assume that the LED is connected to a 5 V voltage source, the resistance of a resistor connected in series to the LED is predetermined such that the quantity of light output from the LED is adjustable to make the reflection voltage from the background (corresponding to a white pattern sensed level) 4.0 V, and a toner is to be supplied when the reflection potential of the pattern portion is not lower than 1.6 V (corresponding to a black pattern sensed level). When the resistance of the resistor connected with the LED is lowered to increase the light emission by 20%, the reflection voltage from the background (white pattern) becomes 4.8 V and the toner supply threshold voltage for the pattern area (black pattern) becomes 1.92 V. Nevertheless, the density control will occur in the proper manner inasmuch as there still holds the proportional relation $1.6/4=1.92/4.8=0.4$.

However, when the resistance of the resistor connected to the LED is further lowered to increase the light emission by 40%, the reflection voltage in the background does not reach 5.6 V but becomes (source voltage—saturation voltage of phototransistor). That is, assuming that the saturation voltage is 0.2 V, the reflection voltage in the background does not increase beyond 4.8 V and, instead, only the reflection voltage in the pattern area increases by 40%. Therefore, while the toner supply threshold voltage necessary for proper density control is $5.6\times0.4=2.24$ V, the actual voltage becomes $4.8\times0.4=1.92$ V and the toner supply begins in response to such a voltage. As a result, the toner density is controlled to a value higher than the predetermined desired density, which would not only increase the image density but also bring about problems such as fogging and scattering of the toner.

The controlling problems have been described taking for example a prior art method which focuses white and black patterns to a photoconductive element, senses densities of their toner images after development by means of a photosensor, and controls the toner supply based on a ratio between the sensed densities. However, other modes of image density control suffer from the same problems such as erroneous settings or adjustments of the sensor operation level, shifts of the sensing level due to contamination of the sensor, and defects in the patterns themselves, that is, unusual operations in the control of various parameters associated with a density control in unexpected situations.

SUMMARY OF THE INVENTION

It is therefore an object of the present invention to provide an image density control method which eliminates the problems inherent in the prior art methods as described above, that is, precludes failures in image density control due to errors in machine settings and adjustments as well as to subsequent changes in state.

It is another object of the present invention to provide a generally improved image density control method.

A method of controlling a density of an image formed by developing an electrostatic lantet image on a photoconductive element by means of a toner of the present invention comprises the steps of providing at least two regions for independent test patterns which are different from each other as latent images electrostatically formed on a photoconductive element, sensing a value relating to an image density in each of the two pattern regions, compensating the sensed value relating to the image density when the value is out of a predetermined range, and controlling an image density parameter relating to image processing which has influence on image density, in response to the values relating to the image densities which are representative of the two pattern areas regions respectively.

In accordance with the present invention, an image density control method for an electrophotographic apparatus is disclosed which prepares a white pattern region and a black pattern region on a photoconductive element whose electrostatic latent images are far different from each other in potential. Values relating to image densities individually associated with the two pattern regions are sensed and, based on the sensed values, parameters relating to image processing which effect image density are controlled. When any one of the sensed values does not lie in a predetermined range, it is suitably compensated.

The above and other objects, features and advantages of the present invention will become apparent from the following detailed description taken with the accompanying drawings.

DESCRIPTION OF THE PREFERRED EMBODIMENT

While the image density control method of the present invention is susceptible of numerous physical embodiment, depending upon the environment and requirements of use, a substantial number of the herein shown and described embodiment have been made, tested and used, and all have performed in an eminently satisfactory manner.

Figure 1:
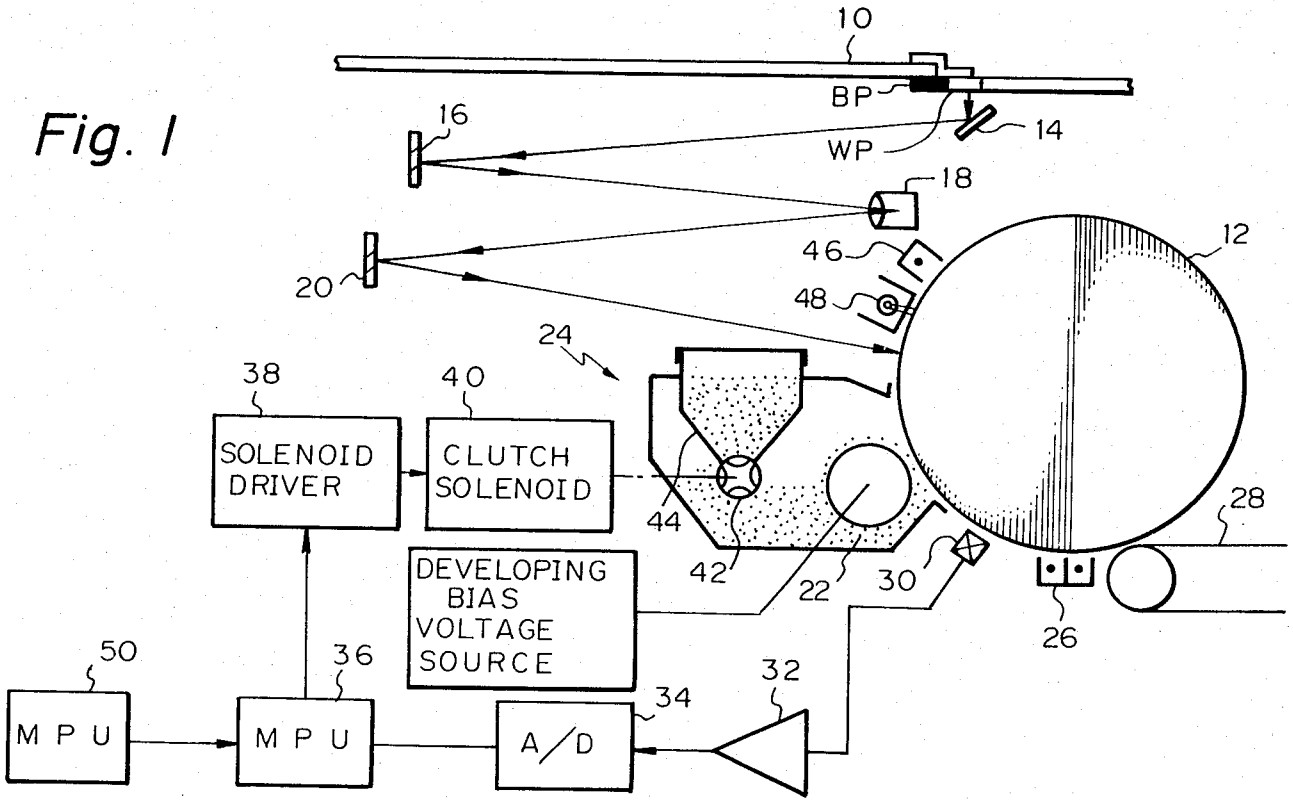
FIG. 1 is a schematic view of an electrophotographic copier to which an image density control method of the present invention is applicable, particularly its construction relating to a toner density control.

Referring to FIG. 1 of the drawings, a copying machine to which the method of the present invention is applicable is shown. Image light representative of an original document (not shown) laid on a glass platen 10 is focused to a surface of a photoconductive drum 12 by a first mirror 14, a second mirror 16, an in-mirror lens 18 and a third mirror 20. Timed to the counterclockwise rotation of the drum 12 as indicated by an arrow, the first and second mirrors 14 and 16 are driven to the left in the drawing with a predetermined velocity ratio. A latent image of the document formed electrostatically on the drum 12 is developed by a developer which is supplied by a developing roller 22 from a developing unit 24. The toner image carried on the drum 12 is transferred therefrom to a sheet of paper (not shown) by a transfer charger 26. The paper is fed from the transfer station to a fixing unit (not shown) by a separator belt 28.

A white test pattern WP is positioned in a range in which the first mirror 14 scans the document at a home position thereof, and a black test pattern BP to the left of the white pattern WP. As the first mirror 14 is driven to the left for scanning the document on the platen 10, latent images of the white pattern WP and black pattern BP are sequentially formed on the surface of the drum 12. A photosensor 30 is interposed between the developing unit 24 and the transfer charger 26 in order to sense toner densities on the drum surface. The output of the photosensor 30 is amplified and shaped by an amplifier 32, converted into a digital signal by an analog-to-digital converter (ADC) 34, and then applied to a microprocessor 36. The microprocessor 36 calculates a density ratio between the toner images representative of the white and black test patterns WP and BP respectively, and thereby a quantity of toner to be supplied. For a period of time corresponding to the calculated toner supply, the microprocessor 36 delivers a solenoid-on command to a solenoid driver 38. While the solenoid-on command is present, the solenoid driver 38 continuously energizes a clutch solenoid 40. On the energization of the clutch solenoid 40, a toner supply roller 42 is coupled to a drive system associated with the drum 12 and rotated thereby to supply the toner from a hopper 44 to the developing roller 22.

The copier shown in FIG. 1 further comprises a main charger 46 for depositing a uniform electrostatic charge on the surface of the drum 12, an erase lamp 48 for expelling the charge out of the areas just before the leading edge of an image and just after the trailing edge of the same as well as the areas outside a sheet size, and a power source 52 for supplying a bias voltage for development. In this particular embodiment, while the microprocessor 36 serves to supply a quantity of toner which corresponds to sensed toner densities, a second microprocessor 50 serves to supply a quantity of toner corresponding to a copy size every time a copy is produced. Therefore, the microprocessor 36 makes up for a shortage entailed by the constant quantity supply.

Figures 2, 2A:
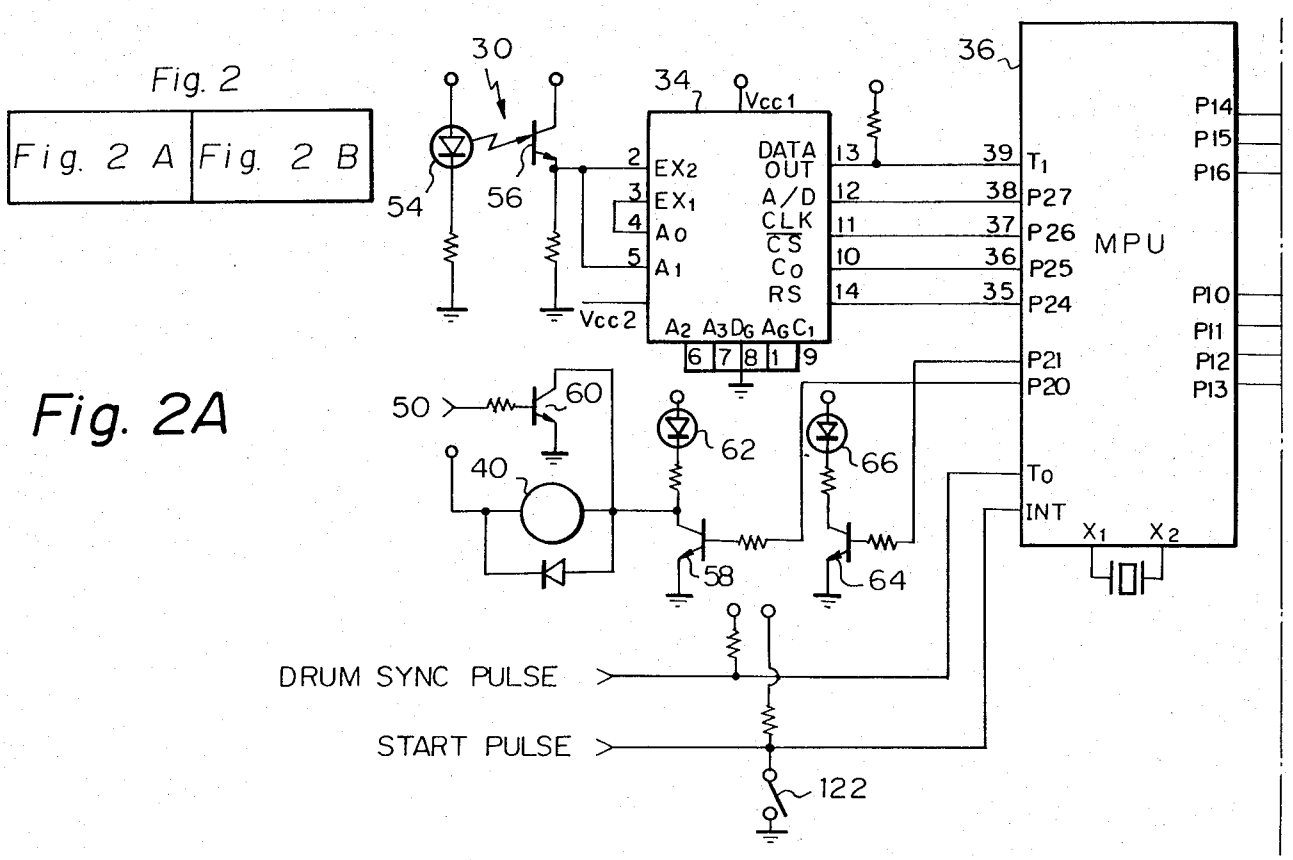
FIG. 2 is a circuit diagram showing electric connections between a microprocessor and an analog-to-digital converter shown in FIG. 1.
Figure 2B:
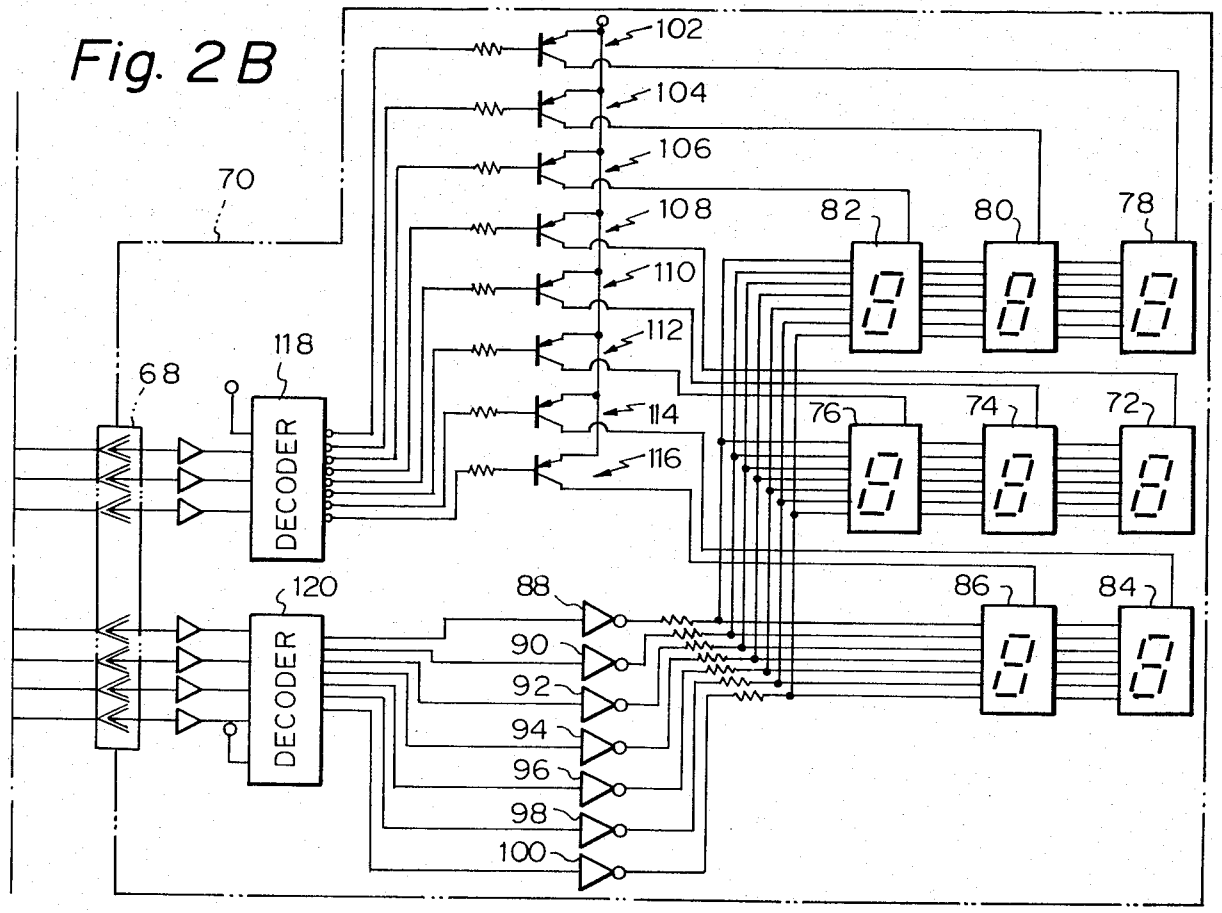

Referring to FIG. 2, details of electric connection of the microprocessor 36 are shown. The photosensor 30 is made up of a light emitting diode (LED) 54 and a phototransistor 56. Light issuing from the LED 54 is reflected by the drum 12 toward the phototransistor 56. The emitter voltage of the phototransistor 56 is applied directly to an input channel $A_1$ of the ADC 34 (e.g. FUJITSU MB 4052) and, via dividing terminals $EX_2$ and $EX_1$, to an input channel $A_0$. A digital data (serial) output terminal DATA OUT of the ADC 34 is connected to an interrupt terminal $T_1$ of the microprocessor 36, and control input terminals (A/D, CLK, $\overline{CS}$, Co and RS) to output ports $P_{24}$–$P_{27}$.

Figure 3:
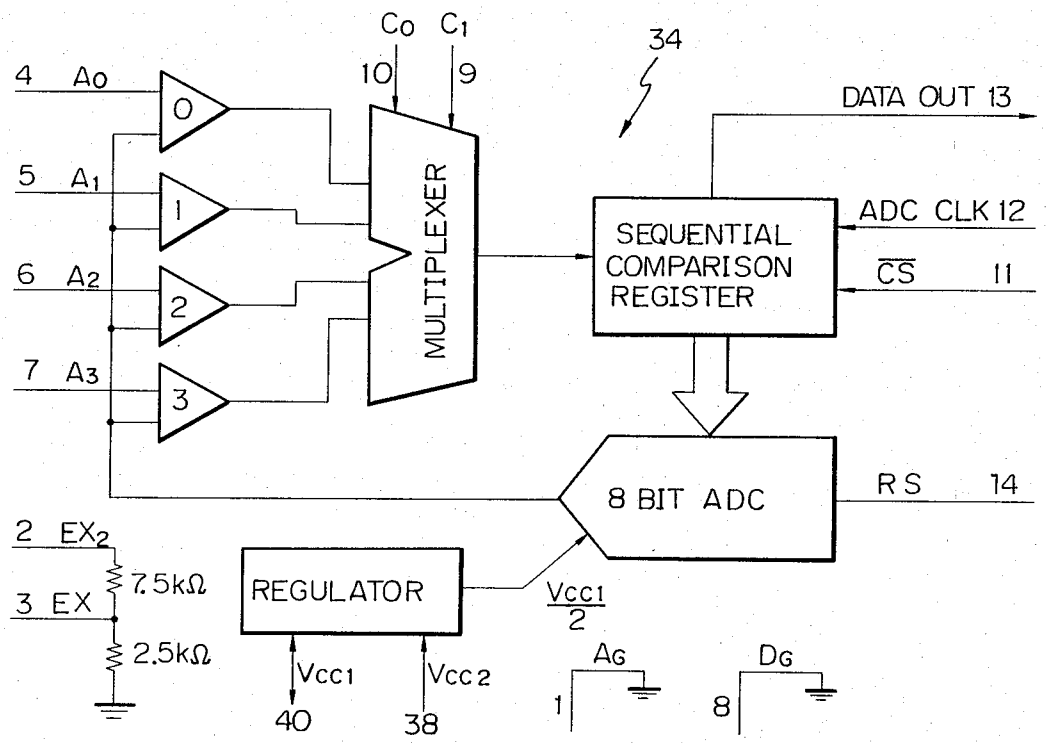
FIG. 3 is a block diagram showing details of the analog-to-digital converter of FIG. 2.
Figure 4A:
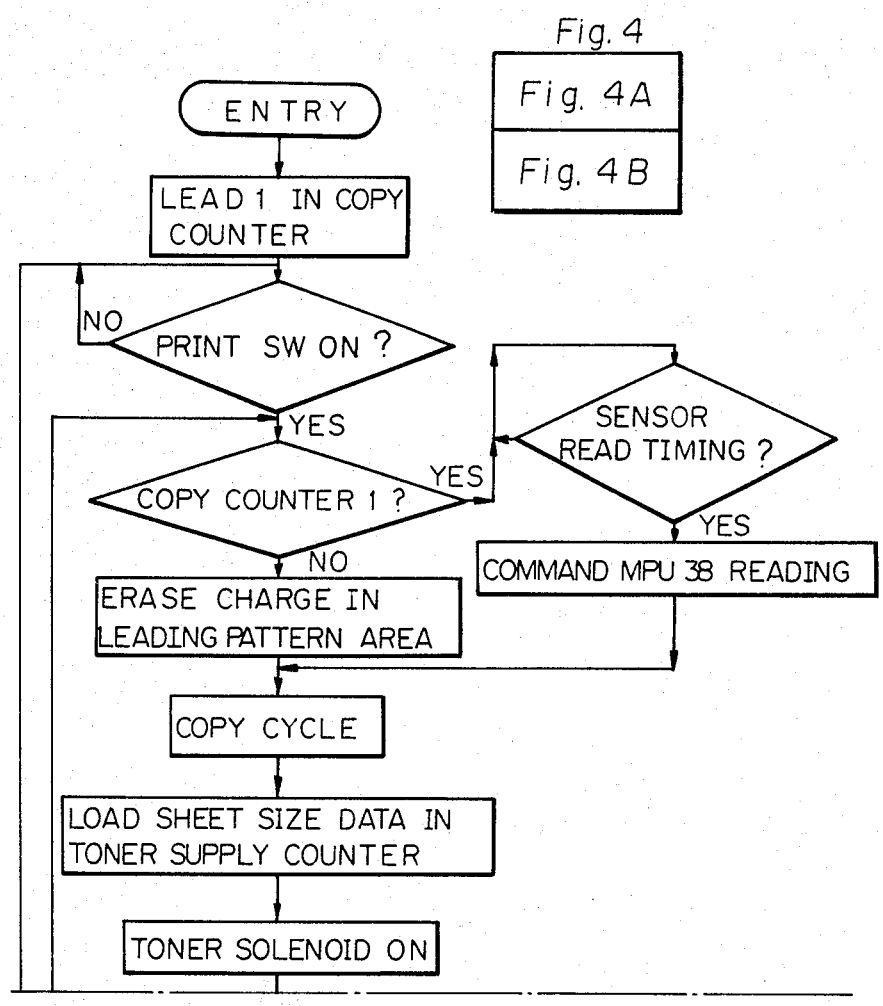
FIG. 4 is a flowchart demonstrating a constant quantity toner supply control and a toner density control.
Figure 4B:
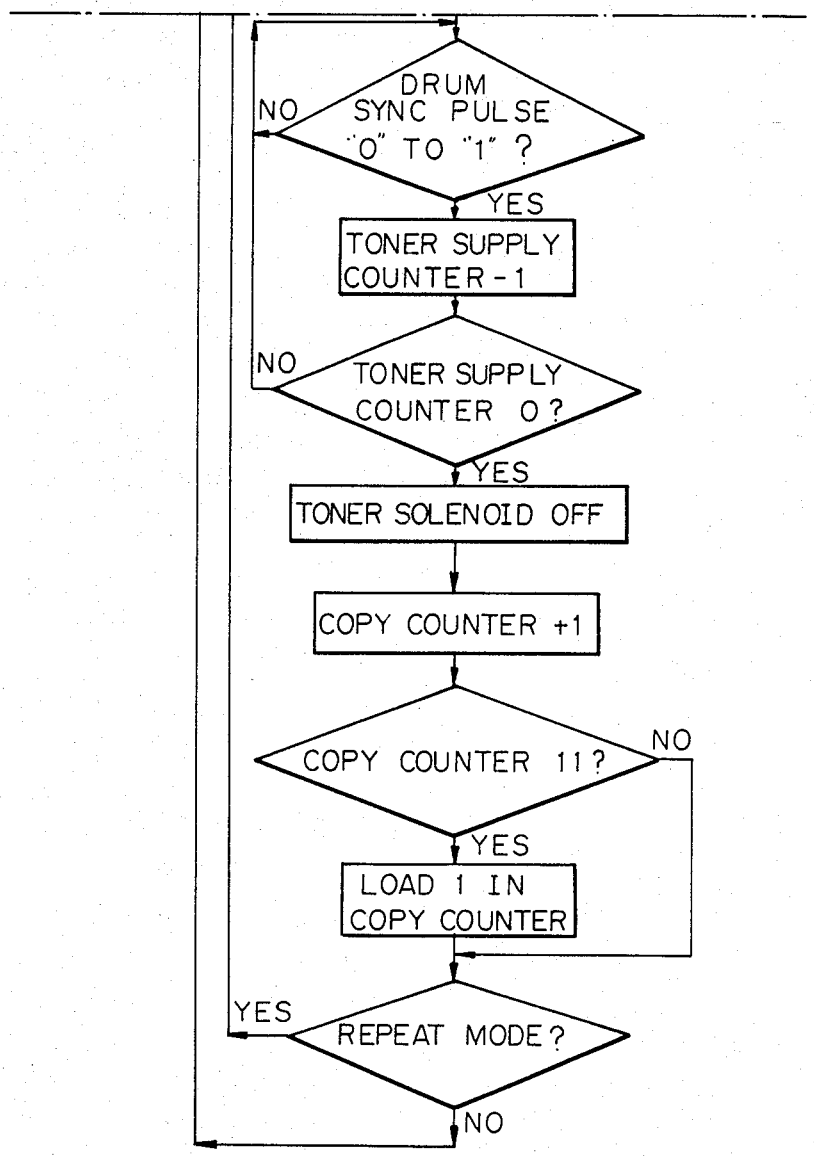

The internal structure of the ADC 34 is shown in FIG. 3. The ADC 34 is capable of performing 8-bit A/D conversion to select a Vcc/2 or Vcc/8 input voltage range by range selection and to expand the range by four stages by range expansion. Preliminary experiments provided the following numerical values.

Assume that the toner density sensing level $V_{WP}$ in an area of the drum 12 corresponding to the white pattern WP (background level) is $$V_{WP}=4.0\ V$$

Then, a proper (normal) range of the density level $V_{WP}$ is $$2.5\ V<V_{WP}<4.8\ V.$$

"A", which will be described, represents data associated with "2.5 V", and "B", "4.8 V".

Meanwhile, assuming that the toner density sensing level $V_{BP}$ in an area of the drum corresponding to the black pattern BP (black level) is $$V_{BP}=1.6\ V$$

Then, a proper (normal) range of the density level $V_{BP}$ is $$0.5\ V<V_{BP}<2.3\ V$$

"C", which will be described, represents data associated with "0.5 V", and "D", "2.3 V".

Based on the above data, use is made of a measurement range $$Vcc/(2\times4)\rightarrow0\text{-}10\ V$$

for the background level $V_{WP}$, and a measurement range $$V_{BP}/2\rightarrow0\text{-}2.5\ V$$

for the black level $V_{BP}$, each employing range expansion.

Because the emitter of the phototransistor 56 is connected to $EX_2$ of the ADC 34 while $EX_1$ is connected to the input channel $A_0$, the range is expanded by four times in the A/D conversion which designates the input channel $A_0$, as produced by $2.5/(7.5+2.5)=\frac{1}{4}$. For this reason, the input channel $A_0$ is allocated for the detection of the background level $V_{WP}$. Also, because the emitter of the phototransistor 56 is directly connected to the input channel $A_1$, the input channel $A_1$ is allocated for the detection of the black level $V_{BP}$. It follows that a product of the A/D converted version of $V_{WP}$ and "4" and the A/D converted version of $V_{BP}$ lie in a common range. That is, the digital outputs n and input voltages are related as follows:

$$V_{WP}(n)=62+(n-1)\times39.126\ mV$$

$$V_{BP}(n)=17+(n-1)\times9.7756\ mV$$

For example, where the background level $V_{WP}(n)$ is 103, $$V_{WP}(analog)=62+102\times39.126\ mV=3.991\ V$$

and where the black level $V_{BP}(n)$ is 163, $$V_{BP}(analog)=17+162\times9.7756\ mV=1.6006\ V$$

In FIG. 2, the solenoid driver 38 (FIG. 1) comprises a switching transistor 58 whose base is connected to an output port P20 of the microprocessor 36. Connected to the collector of the transistor 58 is the clutch solenoid 40. When the output port P20 is made logical "1" level, the transistor 58 is rendered conductive to cause a current to flow through the clutch solenoid 40 thereby coupling the toner supply roller 42 (FIG. 1) to the drive mechanism for rotation. A transistor 60 is connected to the clutch solenoid 40 in order to supply the toner by a quantity which matches with a specific copy size, every time a copy is produced. Thus, the toner will also be supplied when the transistor 60 is turned on.

The transistor 60 is on-off controlled by the copy control microprocessor 56. While at least one of the transistors 58 and 60 is turned on, that is, during a toner supply, an LED 62 connected to one end of the solenoid 60 is turned on to display the toner supply. A transistor 64 is connected at its base to an output port P21 of the microprocessor 36. A monitor LED 66 is connected to the transistor 64. The microprocessor 36 turns on the transistor 64 to energize the LED 66 at the start of A/D conversion, and turns off the transistor 64 to deenergize the LED 66 after a predetermined procedure for setting a toner supply quantity.

An interrupt terminal INT of the microprocessor 36 receives from the microprocessor 50 a toner density control command signal which is a train of pulses appearing one for each ten copies while the copier is powered. An interrupt terminal T0, on the other hand, receives a train of drum rotation sync pulses which appear one for every predetermined small angular movement of the drum 12. As will be described, the microprocessor 36 controls toner supply by counting the drum rotation sync pulses. A connector 68 is connected to output ports P14–P16 and P10–P13 of the microprocessor 36. In the event of maintenance of the copier, for example, a monitor unit 70 may be connected to the connector 68.

The monitor unit 70 comprises character displays 72, 74 and 76 for showing a sensed white pattern toner density level $V_{WP}$, character displays 78, 80 and 82 for showing a sensed black pattern toner density level $V_{BP}$, character displays 84 and 86 for showing a density ratio $V_{WP}/V_{BP}$, segment drivers 88, 90, 92, 94, 96, 98 and 100, and digit drivers 102, 104, 106, 108, 110, 112, 114 and 116, and decoders 118 and 120. When the monitor unit 70 is plugged into the connector 68, instantaneous data $V_{WP}$, $V_{BP}$ and $V_{WP}/V_{BP}$ will be displayed thereon. Designated by the reference numeral 122 in FIG. 2 is a toner density control command switch which will start a toner density control when closed a moment for services.

Figures 1, 5A:
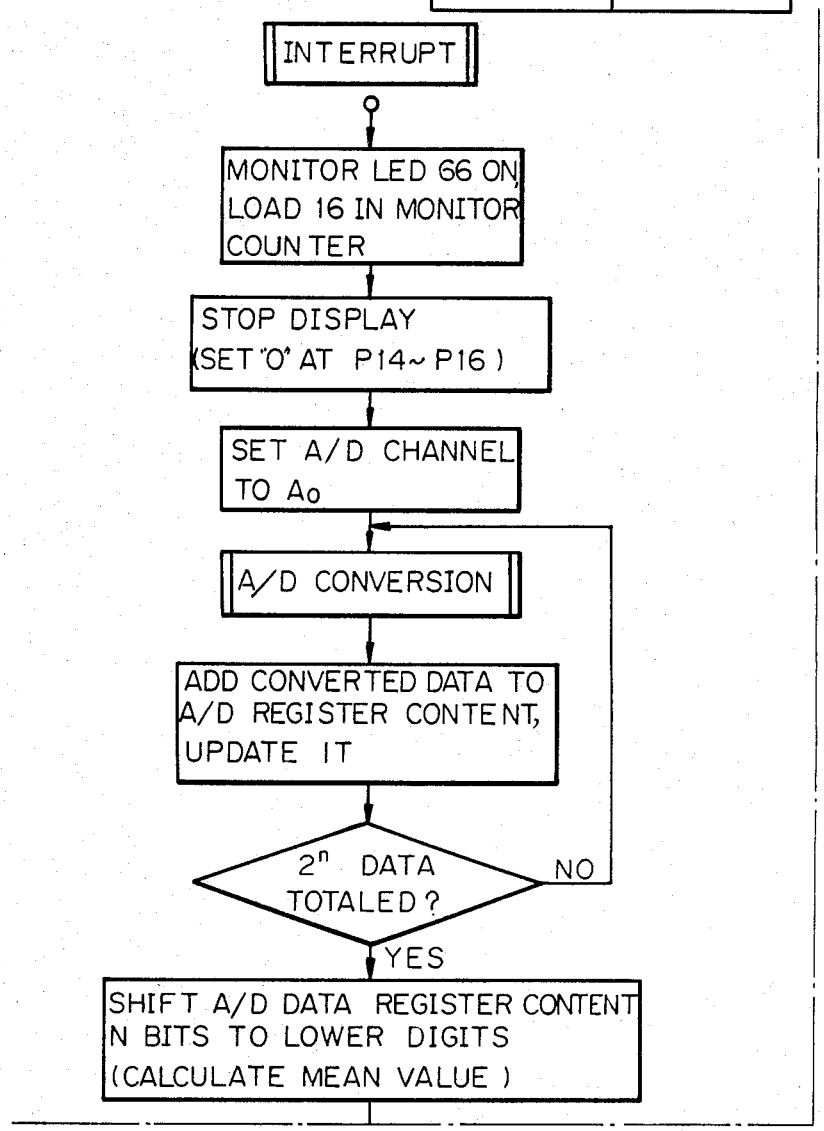
FIG. 5*a* is a flowchart demonstrating an interrupt processing performed by a microprocessor.
Figures 2, 5A:
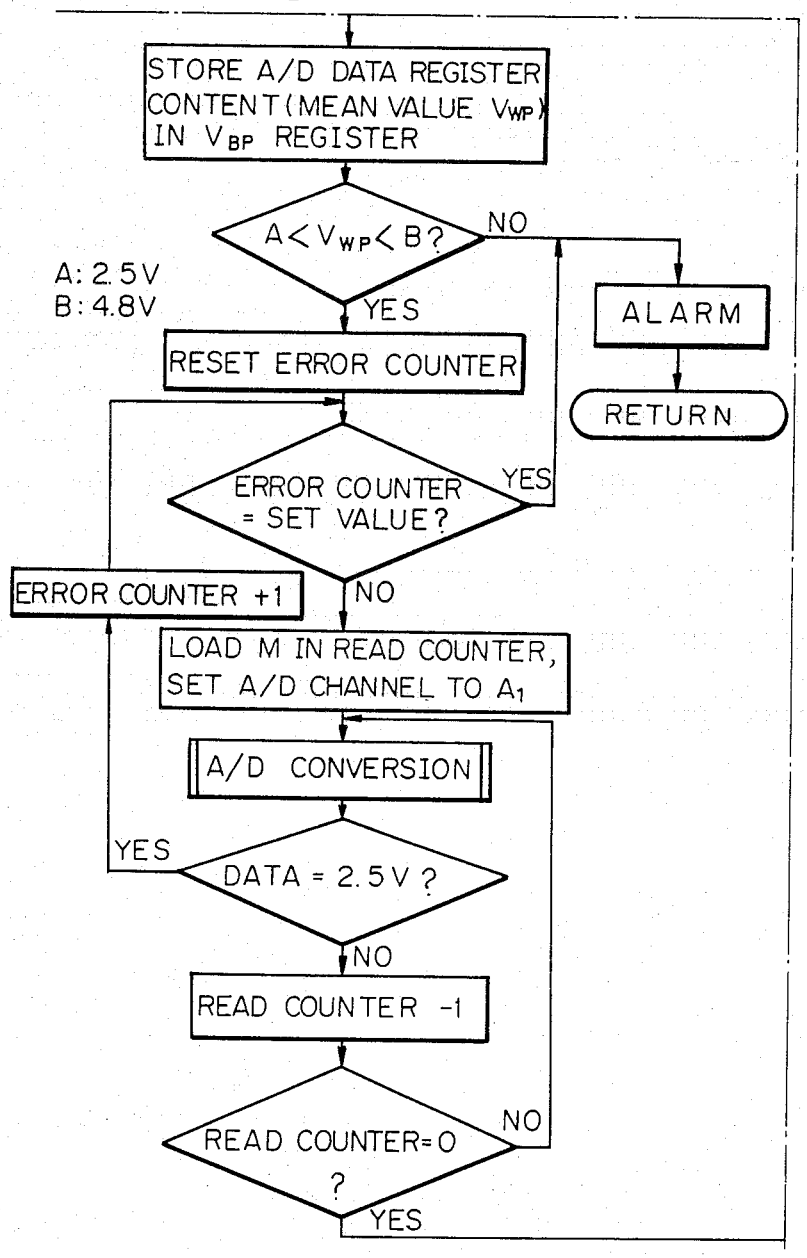
Figures 3, 5A:
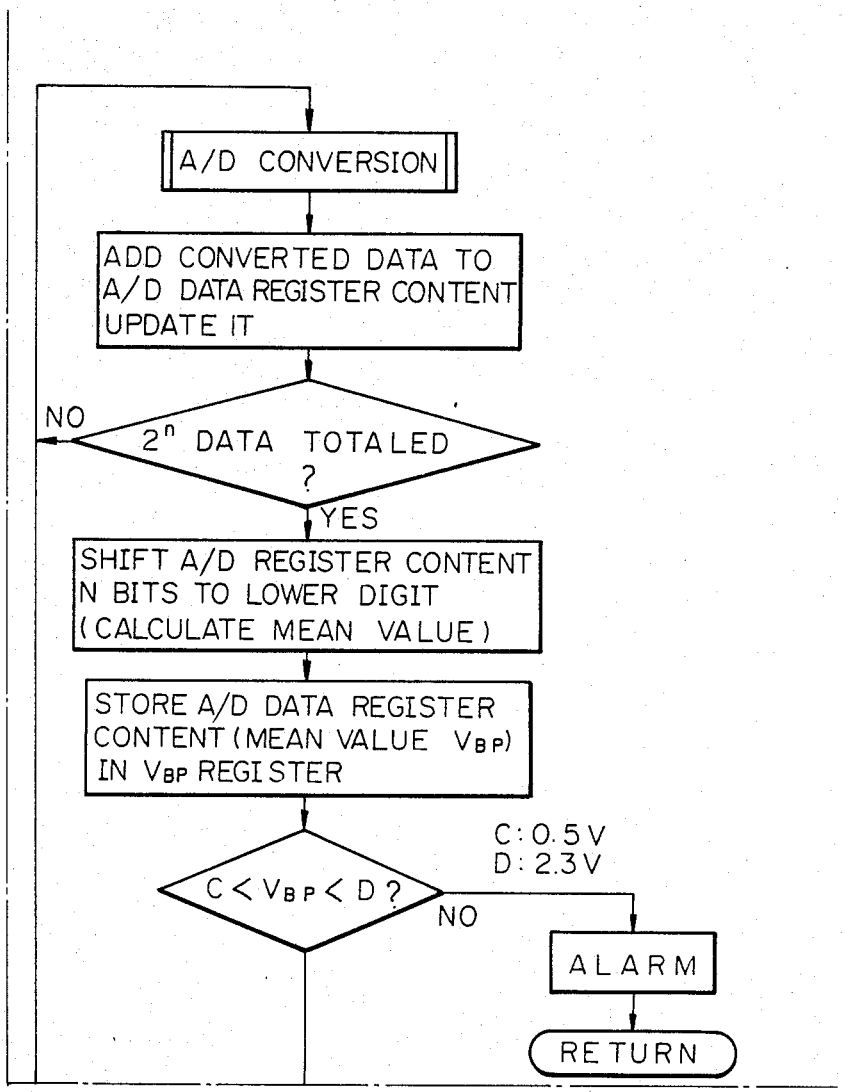
Figures 4, 5A:
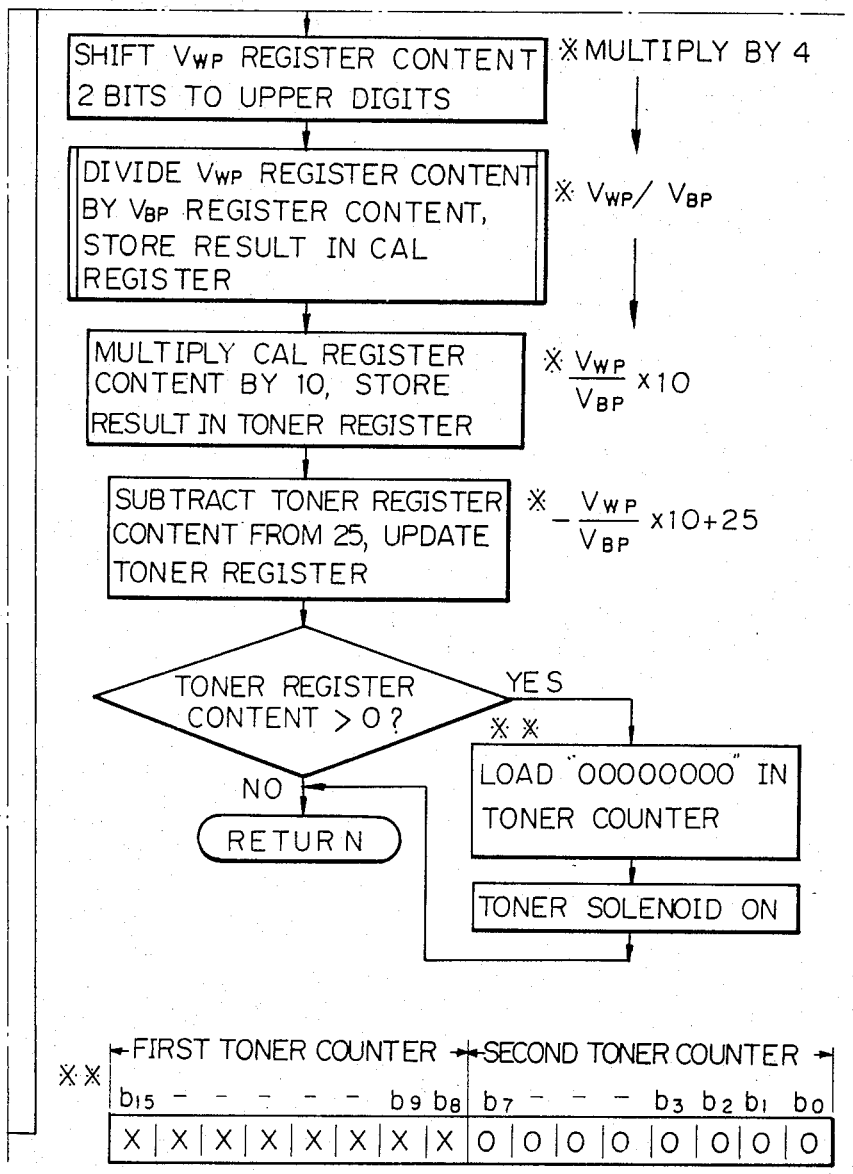

Referring to FIG. 4, part of a copy control flow performed by the microprocessor 50 is outlined giving major consideration to the constant quantity toner supply. As soon as various sections of the copier become ready for a copying operation, the microprocessor 50 awaits closing of a print switch (copy command) after loading "1" in a copy counter (program counter), which is adapted for a toner density control command timing. On the closing of the print switch, the microprocessor 50 energizes the charger 46, starts an imaging operation, and begins to count drum rotation sync pulses. As the white pattern WP projected by the first mirror 14 onto the drum 12 reaches the photosensor 30, the microprocessor 50 supplies a toner density control command signal (start pulse) to the interrupt terminal INT of the microprocessor 36. While the count of the copy counter is in the range of "1" to "10", no start pulse is supplied and the erase lamp 48 is energized to dissipate the charge down to the black pattern BP. Thereafter, the copy control is continued.

When one copying cycle is completed, the microprocessor 50 loads a toner supply counter (program counter) with sheet size data (toner supply time period matched to a sheet size; number of drum rotation sync pulses), turns on the transistor 60 (FIG. 2), and then decrements the toner supply counter in response to every drum rotation sync pulse. On the decrement of the toner supply counter to "0", the microprocessor 50 turns off the transistor 60. This is followed by incrementing the copy counter by "1". Then, the microprocessor 50 starts another copying cycle if the preset mode is the continuous or repeat mode, while awaiting closing of the print switch if it is the single copy mode. Every time the copy counter reaches "11", the microprocessor 50 resets it to "1". The microprocessor 50 causes the microprocessor 36 to perform the toner density control only, when the count of the copy counter is "1". Hence, the toner density control occurs once for ten copies while the copier is in operation.

Hereinafter will be described the toner density control performed by the microprocessor 36. In response to a toner density control command pulse (start pulse) supplied from the microprocessor 50 to the interrupt input INT, the microprocessor 36 performs on an interrupt control basis the detection of toner densities on the drum 12 representative of the white and black patterns WP and BP respectively, comparison of actual toner densities with predetermined proper range data, and setting of a quantity of toner supply based on the detected values when they individually lie in the proper ranges. The control over the predetermined quantity of toner supply and the control over the activation of the displays 72, 74, 76, 78, 80, 82, 84 and 86 occur as specified by the main routine.

Referring to FIG. 5*a* which is a flow-chart representing the interrupt control, the microprocessor 36 sets logical "1" at its output port P21 when the interrupt terminal INT turns from logical "1" to logical "0". This energizes the monitor LED 66 while loading a monitor counter (program counter) with "16". Then, the microprocessor 36 sets logical "0" at the output ports P10–P13 and P14–P16 to erase data on the displays 72, 74, 76, 78, 80, 82, 84 and 86, and designates the input channel $A_0$ of the ADC 34. In this condition, the microprocessor 36 delivers a data conversion timing pulse (A/D CLK) to the ADC 34 so as to read the digital data (8 bits) serially at its port $T_1$. The incoming digital data are added to data stored in an A/D data register. After repeating the A/D conversion and data addition procedure "$2^n$" times, the microprocessor 36 shifts the content of the A/D conversion data register by "n" bits to lower digits, so that the content of the A/D register represents a mean value of data provided by the "$2^n$"A/D conversions.

As previously described, the toner density control command pulse (start pulse) to the interrupt terminal INT of the microprocessor 36 appears timed to the arrival of the toner image of the white pattern WP at the sensor 30. Therefore, the aforementioned A/D converted data designated by the input channel $A_0$ indicates a toner density ($V_{WP}$) of the white level. The microprocessor 36 stores in a $V_{WP}$ register the mean value of white level tone densities $V_{WP}$. Comparing the stored mean value with proper range data A and B (A corresponding to 2.5 V and B to 4.8 V), the microprocessor 36 resets an error counter if $A<V_{WP}<B$ determining that the density level is proper, thereafter advancing to the detection of a change to the black pattern. If not $A<V_{WP}<B$, on the other hand, the microprocessor 36 turns on an alarm lamp determining that the density level is improper, and then returns to a failure processing flow of the main routine while stopping the operation of the copier. Therefore, no toner supply setting is performed.

If $A<V_{WP}<B$ (if proper), the microprocessor 36 loads a read counter (program counter) with a serial count m in order to detect the border between the toner image of the white pattern WP and that of the black pattern BP, followed by A/D conversion in the manner described. As previously stated, the voltage representative of a sensed voltage is directly applied to the input channel $A_1$ (without being divided); the maximum value of the input analog voltage control is 2.5 V; the toner density detection voltage (analog) associated with the white pattern is not lower than 2.5 V; and that the toner density detection voltage associated with the black pattern is less than 2.5 V. For these reasons, whether the pattern is white or black is represented by whether the voltage at the input channel $A_1$ is not lower than 2.5 V (2.5 V at full-scale and, therefore, digital data being 2.5 V if not smaller than 2.5 V).

When the digital data indicates 2.5 V, the microprocessor 36 increments the error counter to perform another A/D conversion determining that the sensor 30 is still sensing the white pattern. This counter increment and A/D conversion procedure is repeated. As the A/D conversion data comes to indicate a voltage lower than 2.5 V before the error counter reaches a predetermined value, the read counter is decremented by "1" and another A/D conversion is effected. If the data after the continuous "m" times of A/D conversion is lower than 2.5 V (as the read counter reaches "0"), the microprocessor 36 subjects the voltage at the input channel $A_1$ of the ADC 34 to "$2^n$" times of A/D conversion and stores the result in an A/D conversion data register, determining that the toner image of the black pattern exists in the sensing range of the sensor 30.

When the error counter has been incremented to a predetermined count (when data has failed to become lower than 2.5 V during a predetermined number of times of A/D conversion), the microprocessor 36 regards the situation unusual (the black pattern has not been detected at the expected timing) and, thereby, energizes the alarm lamp, returns to the failure processing flow of the main routine, and deactivates the copier. When the data shows 2.5 V even once during the repeated "m−1" times of A/D conversion after the A/D conversion data has once indicated a voltage lower than 2.5 V, "m" is loaded again in the read counter and A/D conversion is repeated until the voltage continuously remains lower than 2.5 V in another "m" times of A/D conversion.

After "$2^n$" times of A/D conversion and data totalization, the microprocessor 36 shifts the content of the A/D data register "n" bits toward lower digits causing the A/D data register to represent a mean value of the detected input voltages $V_{BP}$. At this state of operation, $V_{WP}$ indicates a value $\frac{1}{4}$ the mean value of "n" times of sampling of the white level, while $V_{BP}$ indicates a mean value of "n" times of sampling of the black level.

The microprocessor 36 now compares the sensed density level $V_{BP}$ with the proper range data C and D which correspond to 0.5 V and 2.3 V respectively. If $C<V_{BP}<D$, the microprocessor 36 regards the situation proper and advances to the calculation of the ratio $B_{WP}/V_{BP}$. If otherwise, the microprocessor 36 determines the situation improper, energizes the alarm lamp, and returns to the failure processing flow of the main routine to stop the copier operation. This allows no toner supply setting to occur.

If $C<V_{BP}<D$, the microprocessor 36 shifts the content of the $V_{WP}$ register two bits toward lower digits to multiply it by "4", thereby compensating for the scale-up (four times; dividing input voltage to $\frac{1}{4}$). This makes the content of the $V_{WP}$ register common in scale to the $V_{BP}$ register. The microprocessor 36 divides the content of the $V_{WP}$ register by that of the $V_{BP}$ register to produce the ratio $V_{WP}/V_{BP}$, and stores it in a calculation (CAL) register. Therefore, the content of the CAL register indicates a density ratio $V_{WP}/V_{BP}$ which has no relation with the scale.

Next, the microprocessor 36 multiplies the content of the CAL register by "10", stores the product in the toner register, and then updates the toner register to store a difference between the product and "25". The resulting content of the toner register is $-(V_{WP}/V_{BP})\times 20+25$. The above equation has the following meaning. Preliminary experiments showed that the toner supply is needless if the reciprocal number $V_{BP}/V_{WP}$ of the toner density ratio $V_{WP}/V_{BP}$ is less than 40%, while it is required 1 gram for each 1.7% increase if the toner density ratio is not less than 40%. Therefore, toner supply is required as tabulated below.

| $V_{BP}/V_{WP}$ (%) | TONER SUPPLY (%) | $V_{WP}/V_{BP}\times 10$ |
|---|---|---|
| 40 | | 25 |
| 41.7 | 1 | 23.98 |
| 43.4 | 2 | 23.04 |
| 45.1 | 3 | 22.17 |
| 46.8 | 4 | 21.37 |
| 48.5 | 5 | 20.62 |
| 50.2 | 6 | 19.92 |
| 51.9 | 7 | 19.27 |
| 53.6 | 8 | 18.66 |

In case where the photosensor is employed in combination with a constant toner supply, the variation in the photosensor output becomes small and a quantity of toner supply larger than a proportional quantity gives rise to no problem when the toner shortage is excessive. In light of this, the toner supply conditions are predetermined as follows:

$$25 - V_{WP}/V_{BP}\times 10 \leqq \text{no supply}$$

$$25 - V_{WP}/V_{BP}\times 10 > \text{supply } \underline{n} \text{ (integer) gram by omission}$$

In view of the currently practiced toner supply to a developing unit 1 g=13.04 sec:1794 PLS (number of drum rotation pulses), the toner supply in practice is approximated for calculation as $$7\times 256 \text{ PLS}=1792 \text{ PLS}=0.999 \text{ g}$$

It will be seen from the above that the toner supply quantity X (g) is attained as produced by $$X=(25-V_{WP}/V_{BP}\times 10)\times 0.999\approx 25-(V_{WP}/V_{BP}\times 10)$$

Therefore, the content of the toner register represents a quantity of toner supply. Because the supply of about one gram of toner corresponds to a period of time for which 1,792 drum rotation sync pulses are counted, the clutch solenoid 40 is to be energized for a period of $X\times 1792=X\times 7\times 2^8$. Thus, the microprocessor 36 stores $X\times 7\times 2^8$ in a first toner counter (register) allocated to lower eight bits and a second toner counter (register) allocated to upper eight bits. This is attained by storing "0" in all the bits of the lower 8-bit first toner counter, and binary data indicative of "X×7" in the upper 8-bit second toner counter. After storing a toner supply time (number of drum rotation sync pulses) in the first and second toner counters, the microprocessor 36 sets logical "1" at its output port P20, energizes the clutch solenoid 40, and then returns to the main routine (FIG. 5*b*).

Figures 1, 5B:
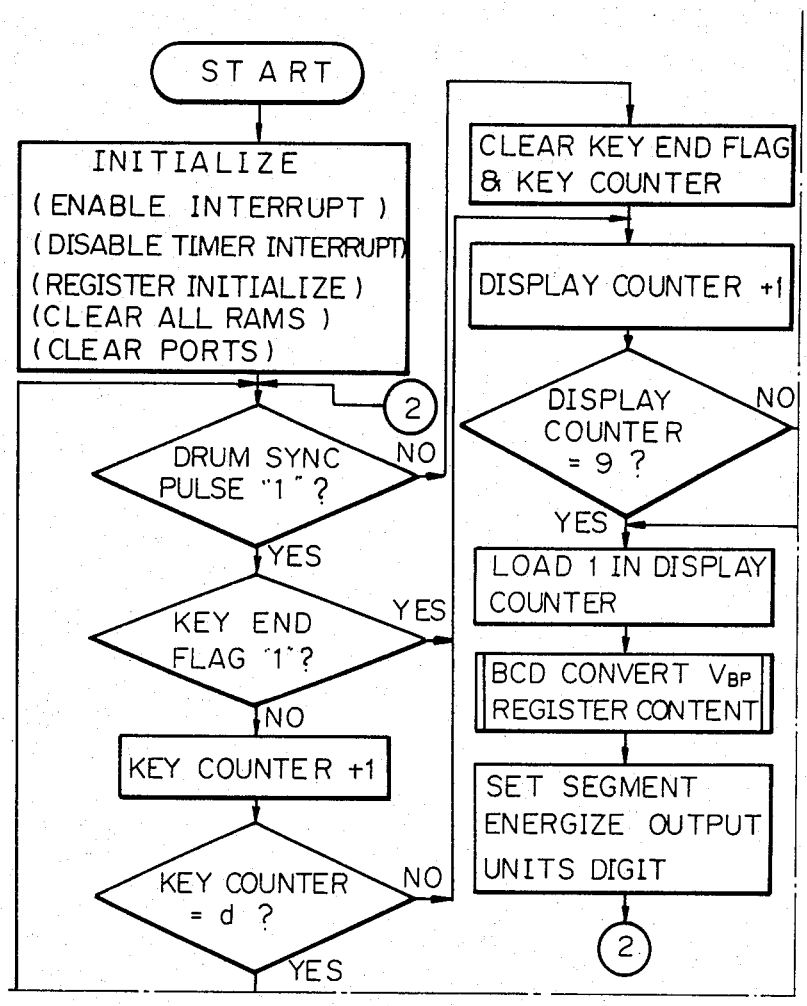
FIG. 5*b* is a flowchart demonstrating a main flow assigned to the microprocessor.
Figures 2, 5B:
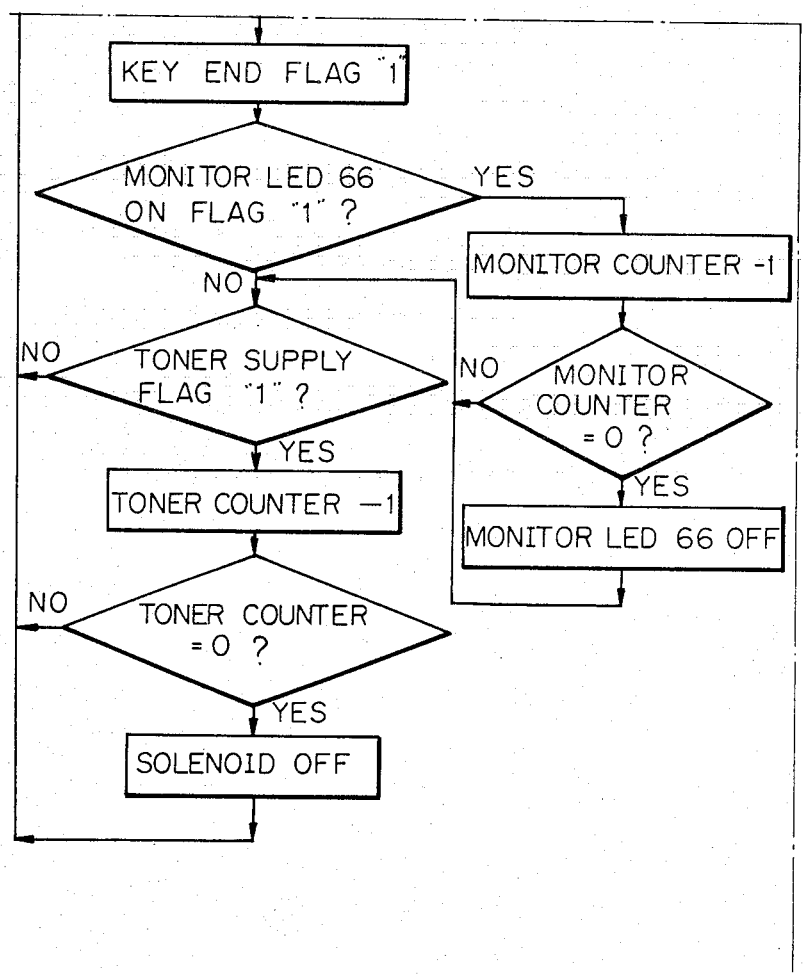
Figures 3, 5B:
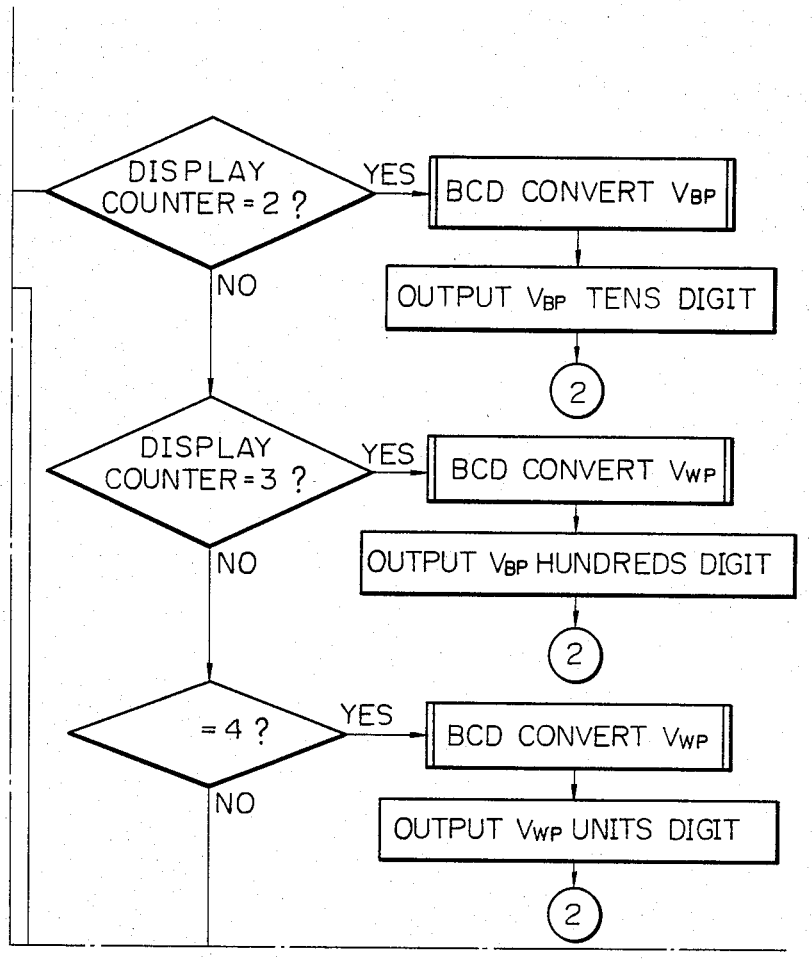
Figures 4, 5B:
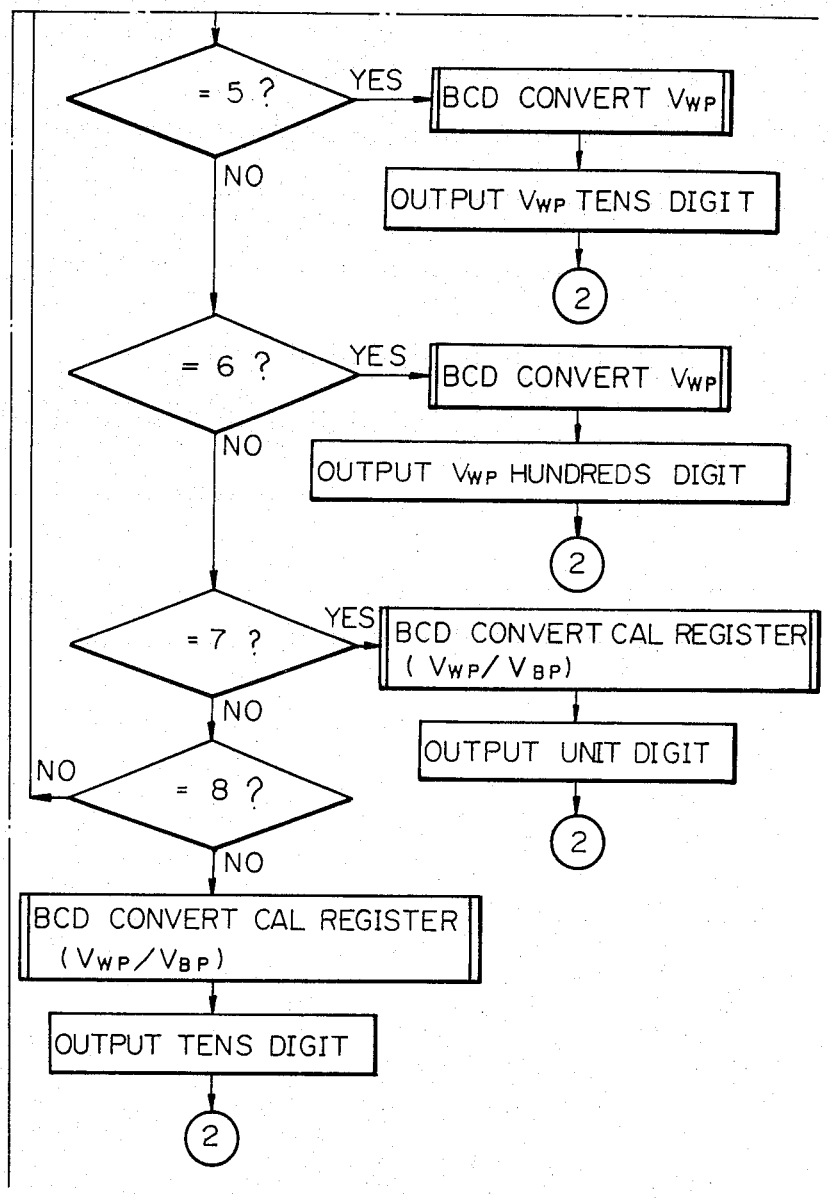

Reference will be made to FIG. 5*b* for describing the main routine of the microprocessor 36. In the main routine, while the drum sync pulse (port T0) is logical "0", the microprocessor 36 performs a display energization control such that the displays 78, 80 and 82, the displays 72, 74 and 76, and the displays 84 and 86 sequentially emit light on a time sharing basis. As soon as the logical level of the drum sync pulse signal (port T0) turns from "0" to "1", the microprocessor 36 increments a key counter (program counter) by "1", energizes one display (one digit), and checks the signal level at the port T0. While the signal level at the port T0 is logical "1", such a procedure is repeated. When repeated it $\alpha$ times, the microprocessor 36 determines that the port T0 has been logical "1" for that while and a logical "1" drum rotation sync pulse has arrived. Then, the microprocessor 36 sets a key end flag 1 indicative of the arrival of the sync pulse and, if a flag indicative of energization of the monitor LED 66 (monitor LED 66 on-flag) is present (logical "1"), decrements the monitor counter. On the decrement of the monitor counter to "0", the microprocessor 36 deenergizes the LED 66.

As previously described (FIG. 5*a*), when the microprocessor 50 has supplied the microprocessor 36 with a toner density control command pulse, "16" is loaded in the monitor counter and the monitor LED 66 is energized. After the procedure from density detection to toner supply time setting (first and second toner counters), the microprocessor advances to the main routine (FIG. 5*b*). Therefore, every time a drum rotation sync pulse appears in the main flow shown in FIG. 5*b*, the monitor counter is decremented by "1". As a result, the monitor LED 66 is deenergized on the appearance of sixteen drum rotation sync pulses after the interrupt processing shown in FIG. 5*a*.

Setting the key end flag 1 (indicating the arrival of one drum rotation sync pulse), the microprocessor 36 sees the toner supply flag and, if it is logical "1" indicative of energization of the clutch solenoid 40, decrements the first and second toner counters by "1". When the toner counters are individually decremented to "0", the microprocessor 36 deenergizes the clutch solenoid 40. While the first and second toner counters are not zero, the microprocessor awaits a turn of the logical level of the drum sync pulse to "0" and, in that while, performs the display energization control. In response to logical "0" of the drum sync pulse, the microprocessor 36 determines that the arrival of one pulse has completed and, therefore, clears the key end flag and key counter and awaits a turn of the port T0 to logical "1" while energizing the display.

In the manner described, in response to every drum rotation sync pulse, the microprocessor 36 decrements the first and second toner counters. When the first and second toner counters have been decremented to "0", that is, on the lapse of a toner supply time after it has been set in the toner counters and the clutch solenoid 40 has been energized, the microprocessor 36 deenergizes the clutch solenoid 40. Thereafter, the microprocessor performs display energization control only.

As described hereinabove, the principles of the present invention are derived from the fact that the voltage picked up by sensing a toner density of a white pattern and that picked up by sensing a toner density of a black pattern are far different from each other, i.e., above 4 V concerning the former and about 1.7 V concerning the latter, and that the A/D converter 34 receives an input voltage of 2.5 V at the maximum and develops digital data indicative of 2.5 V whenever the input voltage is higher than 2.5 V. After sensing a toner density in the white pattern area, the construction shown and described advances to the operation for sensing a toner density of the black pattern only when the output data of the ADC 34 has come to indicate a voltage lower than 2.5 V and all the following "m" times of detection have given voltages lower than 2.5 V, determining that the black pattern is in the sensing range of the photosensor 30. This allows the pattern density sensing timing to be set with ease, that is, it requires only the read timing for the white pattern, which is the first pattern, to be preset. Even though the magnification of the copier may be varied, it is needless to modify the read timing.

Figure 6:
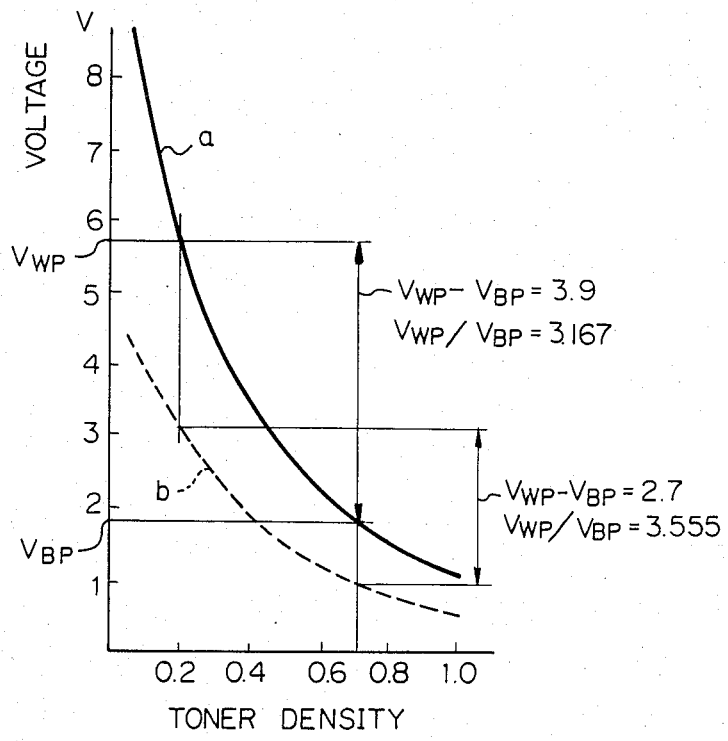
FIG. 6 is a graph showing a relationship between an output voltage of a photosensor and a toner density.

Because the toner supply quantity is determined on the basis of a toner density ratio $V_{WP}/V_{BP}$ between the white and black patterns, the toner density control remains relatively stable against variations in sensor characteristic or in drum surface characteristic. For example, assume that the photosensor 30 usually develops voltages as shown by a solid curve a in FIG. 6, and that such a characteristic curve has shifted to a dotted curve b due to a change in the characteristic of the photosensor 30 and/or that of the drum 12. Then, the difference between the voltages $V_{WP}$ and $V_{BP}$ representative of the toner images of the white and black patterns is reduced from 3.9 V to 2.7 V, resulting in a change of $(3.9-2.7)/3.9\times100=30\%$. Nevertheless, the ratio $V_{WP}/V_{BP}$ changes from 3.167 to 3.555 which is not more than $(3.555-3.167)/3.167\times100=12.3\%$, remaining stable despite changes in the characteristic of the sensor and/or that of the drum surface. If the sensor output voltages are far beyond proper ranges, an alarm is produced and a toner supply quantity is not set. This is successful to eliminate excessive supply of toner which would result in scattering of toner particles, or omission of toner supply which would allow carrier particles to be scattered.

In the embodiment shown and described, the resolution for the A/D conversion of the voltage $V_{BP}$ associated with the black pattern toner image is selected to be four times the resolution for the voltage $V_{WP}$ associated with the white pattern toner image. As well known in the art, a developed toner image has microscopic white and/or black spots scattered therein so that the sensed level varies from one portion to another on a common pattern, if insignificant. The absolute value of such a fluctuation is large in the case of $V_{WP}$ and small in the case of $V_{BP}$. Hence, if resolutions are predetermined one-to-one correspondence with the patterns so that the voltage levels input to the ADC may be of the same order, the fluctuation of one sensed level can be prevented from being weighted heavier than the other.

In the case of A/D conversion, it is preferable that, for a common resolution, the range containing both the voltages $V_{WP}$ and $V_{BP}$ be wide and the number of bits of A/D data be as small as possible from the construction and calculation standpoint. Selecting different resolutions for different patterns as described is effective to reduce the required number of A/D data bits to thereby simplify the construction and calculation.

While the white and black (charge) patterns have been shown and described as being provided by scanning optical marks WP and BP which are located at an edge of the glass platen 10, they may be formed by the charge-uncharge control over the charger 46, on-off control over the exposing lamp, on-off control over the erase lamp 48, or the control over the bias voltage applied to the developing roller 24.

In the embodiment, a value relating to an image density has been sensed by a photosensor 30 as a density of a developed toner image representative of a charge pattern (white or black). Alternatively, such a value may be attained by sensing a surface potential of a charge pattern before development, a surface potential of a developed charge pattern, a surface potential of a developed charge pattern toner image, or a density of a toner image transferred to a paper sheet.

To maintain the image density constant, the embodiment shown and described has employed a ratio between values relating to image densities of different patterns to determine a quantity of toner supply. If desired, the ratio between the different values associated with image densities may be used to control the charger, the amount of exposure, the bias voltage for development, the toner supply to a developer, the toner supply to a developing station, and/or the transfer potential, or even a combination thereof.

In any case, the value relating to an image density quite differs from one pattern to the other and, in addition, such a value fluctuates itself due to changes of various sections with time, ambient temperature, etc. Therefore, it is desirable to subject the values of the respective patterns relating to image densities to A/D conversion employing independent resolutions, calculate a ratio therebetween, and determine an amount of control over an image density parameter.

It will be noted that the image density control method of the present invention is applicable in the same manner to a case wherein various parameters are controlled based on calculation or comparison of a factor other than the pattern density ratio.

While the toner supply has been shown and described as being controlled in proportion to the density ratio $V_{WP}/V_{BP}$, there may be employed a two-level control which blocks toner supply when the ratio $V_{WP}/V_{BP}$ is not smaller than "25", for example (see the table), and supplies a predetermined amount of toner when it is smaller than "25" loading the flrst and second toner counters with the predetermined toner amount.

In summary, it will be seen that the present invention provides an image density control method which in a interrupts a density control for protection purpose situation which would cause the density to be erroneously controlled to eventually damage an apparatus due to errors in setting and adjustment of a sensor, contamination of the sensor, incompleteness or smearing of an object to be sensed, etc.

Various modifications will become possible for those skilled in the art after receiving the teachings of the present disclosure without departing from the scope thereof.

What is claimed is:

1. A method of controlling a density of an image formed by developing an electrostatic image on a photoconductive element by means of a toner, said method comprising the steps of:

(a) providing at least two regions for independent test patterns which are different from each other as latent images electrostatically formed on a photoconductive element;

(b) sensing a value relating to an image density in each of the two pattern regions;

(c) compensating the sensed value relating to the image density in each of the pattern regions when said value is out of a predetermined range; and (d) controlling an image density parameter relating to image precessing which has influence on image density, in response to the values relating to the image densities which are representative of the two pattern regions respectively; step (c) comprising a step of (e) interrupting a control over the image density parameter.

2. A method as claimed in claim 1, in which step (a) comprises a step of (e) defining the two pattern regions by scanning white and black optical marks by means of light.

3. A method as claimed in claim 1, in which step (a) comprises a step of (e) defining the two pattern regions by a charge-uncharge control over a charger.

4. A method as claimed in claim 1, in which step (a) comprises a step of (e) defining the two pattern regions by an on-off control over an exposing lamp.

5. A method as claimed in claim 1, in which step (a) comprises a step of (e) defining the two pattern regions by an on-off control over an erase lamp.

6. A method as claimed in claim 1, in which step (a) comprises a step of (e) defining the two pattern regions by controlling a bias voltage for development which is applied to a developing roller.

7. A method as claimed in claim 1, in which the values relating to the image densities representable of the two pattern regions in step (b) comprise at least one of values of surface potentials in the two pattern regions before development, values of surface potentials in the two pattern regions after development and values of image densities in the two pattern regions which are transferred to a sheet of paper.

8. A method as claimed in claim 1, in which step (c) further comprises a step of (f) energizing a display lamp.

9. A method as claimed in claim 1, in which step (c) further comprises a step of (f) interrupting a recording operation.

10. A method as claimed in claim 1, in whcih the image density parameter in step (d) comprises at least one of a toner concentration in a developer, a charge voltage applied to a charger, a bias voltage for development, an amount of exposure, a transfer potential, and a quantity of toner supply to the developer.

11. A method as claimed in claim 1, in which the pattern regions comprise a white pattern region and a black pattern region.

12. A method as claimed in claim 11, in which the predetermined range of the value relating to the image density in the white pattern region is between 2.5 V and 4.8 V and that in the black pattern region is between 0.5 V and 2.3 V.

13. A method of controlling a density of an image formed by developing an electrostatic image on a photoconductive element by means of a toner in a developer, said method comprising the steps of:

(a) providing at least two regions for independent test patterns which are different from each other as latent images electrostatically formed on a photoconductive element;

(b) sensing a value relating to an image density in each of the two pattern regions;

(c) performing primary toner supply to the developer in accordance with a number of electrostatic images developed by the toner; and (d) performing secondary toner supply to the developer in response to the values relating to the image densities which are representative of the two pattern regions respectively.

14. A method of controling a density of an image formed by developing an electrostatic image on a photoconductive element by means of a toner, said method comprising the steps of:

(a) providing at least two regions for independent test patterns which are different from each other as latent images electrostatically formed on a photoconductive element, the pattern regions comprising a white pattern region and a black pattern region;

(b) sensing an image density in each of the two pattern regions;

(c) producing values relating to the image densities by multiplying the sensed image density of the black pattern region by a constant value which is predetermined in such a manner that the value relating to the image density of the black pattern region will be approximately equal to the value relating to the image density of the white pattern region; and (d) controlling an image density parameter relating to image processing which has influenece on image density, in response to the values relating to the image densities which are representative of the two pattern regions respectively.

* * * * *